US011739626B2

(12) United States Patent
Alzahrani et al.

(10) Patent No.: US 11,739,626 B2
(45) Date of Patent: Aug. 29, 2023

(54) SYSTEMS AND METHODS TO CHARACTERIZE WELL DRILLING ACTIVITIES

(71) Applicant: Saudi Arabian Oil Company, Dhahran (SA)

(72) Inventors: Majed Ateah Alzahrani, Dhahran (SA); William Contreras Otavora, Dhahran (SA); Mohammad Snaytan Al-Nefai, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 963 days.

(21) Appl. No.: 16/588,483

(22) Filed: Sep. 30, 2019

(65) Prior Publication Data

US 2021/0095554 A1 Apr. 1, 2021

(51) Int. Cl.

| | |
|---|---|
| ***E21B 44/02*** | (2006.01) |
| *E21B 21/08* | (2006.01) |
| *E21B 47/04* | (2012.01) |

(52) U.S. Cl.

CPC ..... *E21B 44/02* (2013.01); *E21B 21/08* (2013.01); *E21B 47/04* (2013.01)

(58) Field of Classification Search

CPC ..... E21B 44/02; E21B 21/08; E21B 47/04; E21B 44/00

See application file for complete search history.

(56) References Cited

U.S. PATENT DOCUMENTS 6,892,812 B2 5/2005 Neidermayr et al.
7,128,167 B2 10/2006 Dunlop et al.
(Continued)

FOREIGN PATENT DOCUMENTS

WO 2018038963 A1 3/2018

OTHER PUBLICATIONS

Alotaibi, Bader et al.; "Real-Time Drilling Models Monitoring Using Artificial Intelligence" SPE-194807-MS, SPE Middle East Oil and Gas Show and Conference, Bahrain, Mar. 18-21, 2019; pp. 1-10.

(Continued)

*Primary Examiner* — Andrew Schechter
*Assistant Examiner* — Jeremy A Delozier
(74) *Attorney, Agent, or Firm* — Bracewell LLP; Constance G. Rhebergen; Brian H. Tompkins

(57) ABSTRACT

Provided is a method of drilling a hydrocarbon well that includes conducting a drilling operation, collecting drilling data including characteristics of the drilling operation over a timespan, determining (based on the drilling data) drilling conditions for instants of time within the timespan, determining (based on application of the drilling conditions) preliminary classifications identifying a preliminary classification of the drilling operation for instants of time within the timespan, determining (based on the preliminary classifications) a series of classifications for the drilling operation that each indicate a determined classification for a respective instant of time, determining (based on the series of classifications) a change of classifications, conducting (in response to determining the change of classifications) a change point detection to identify a time of the change of classifications, generating drilling characteristic data indicating the time, and conducting the drilling operation in accordance with the time.

21 Claims, 6 Drawing Sheets

(56) References Cited

U.S. PATENT DOCUMENTS

| | | | | |
|---|---|---|---|---|
| 8,396,826 | B2 | 3/2013 | Mijares et al. | |
| 8,752,648 | B2 | 6/2014 | Goebel et al. | |
| 9,347,288 | B2 | 5/2016 | Clemens et al. | |
| 9,507,754 | B2 | 11/2016 | Fox et al. | |
| 9,582,764 | B2 | 2/2017 | Dursun et al. | |
| 9,934,338 | B2 | 4/2018 | Germain et al. | |
| 2004/0040746 | A1 | 3/2004 | Niedermayr et al. | |
| 2014/0343694 | A1 | 11/2014 | Aldred et al. | |
| 2015/0233792 | A1* | 8/2015 | Gao | G01M 13/045 702/35 |
| 2016/0356144 | A1* | 12/2016 | Toti | E21B 44/00 |
| 2017/0096889 | A1* | 4/2017 | Blanckaert | E21B 44/00 |
| 2018/0096277 | A1* | 4/2018 | Maidla | E21B 44/00 |
| 2019/0024493 | A1 | 1/2019 | Johnson et al. | |

OTHER PUBLICATIONS

Amer, M.M. et al.; "Management of the Change of Operation Classification Coding System for the Next Leap" SPE-192325-MS, SPE Kingdom of Saudi Arabia Annual Technical Symposium & Exhibition, Saudi Arabia, Apr. 23-26, 2018; pp. 1-9.

International Search Report and Written Opinion for International Application No. PCT/US2020/053631, report dated Dec. 11, 2020; pp. 1-16.

* cited by examiner

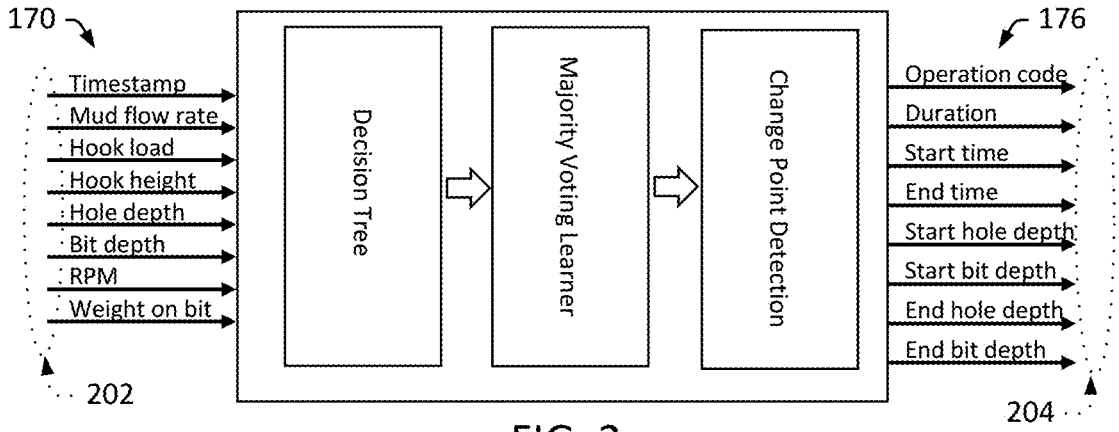
FIG. 2
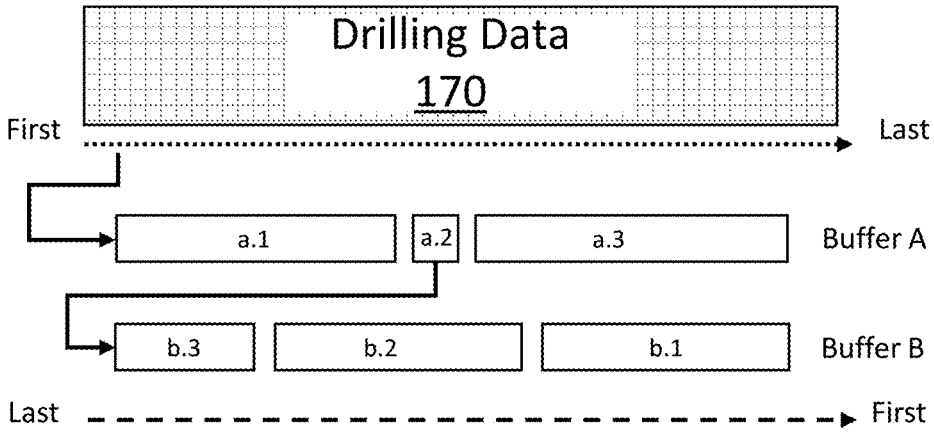
FIG. 4
| Classification Code | Description |
|---|---|
| CD0 | Undefined Status |
| CD1 | Rotary Drilling |
| CD2 | Slide Drilling |
| CD4 | Circulation without Rotation |
| CD5 | Circulation with Rotation |
| CD6 | Reaming |
| CD7 | Back Reaming |
| CD8 | Tripping In |
| CD9 | Tripping Out |
| CD10 | Connection |
| CD11 | Stationary |
| CD12 | Washing |
FIG. 5B

SYSTEMS AND METHODS TO CHARACTERIZE WELL DRILLING ACTIVITIES

FIELD

Embodiments relate generally to developing wells, and more particularly to well drilling activities.

BACKGROUND

A well generally includes a wellbore (or "borehole") that is drilled into the earth to provide access to a geologic formation below the earth's surface (or "subsurface formation"). A well may facilitate the extraction of natural resources, such as hydrocarbons and water, from a subsurface formation, facilitate the injection of substances into the subsurface formation, or facilitate the evaluation and monitoring of the subsurface formation. In the petroleum industry, hydrocarbon wells are often drilled to extract (or "produce") hydrocarbons, such as oil and gas, from subsurface formations.

Developing a hydrocarbon well for production typically involves several stages, including a drilling stage, a completion stage and a production stage. The drilling stage involves drilling a wellbore into a portion of the subsurface formation, such as a portion of the subsurface formation expected to contain hydrocarbons (often referred to as "hydrocarbon reservoir" or "reservoir"). The drilling process is typically facilitated by a drilling rig that sits at the earth's surface, and which can facilitate a variety of operations, such as operating a drill bit to cut the wellbore. The completion stage normally involves making the well ready to produce hydrocarbons, and can include installing casing, perforating the casing, installing production tubing, installing downhole valves for regulating production flow, or pumping fluids into the well to fracture, clean or otherwise prepare the reservoir and well to produce hydrocarbons. The production stage normally involves producing hydrocarbons from the reservoir by way of the well. During the production stage, the drilling rig is typically removed and replaced with a collection of valves at the surface (often referred to as "surface valves" or a "production tree"), and valves may be installed into the wellbore (often referred to as "downhole valves"). The valves can be operated, for example, to regulate pressure in the wellbore, to control production flow from the wellbore and to provide access to the wellbore in the event further completion work is needed. A pump jack or other mechanism may be installed to provide lift that assists in extracting hydrocarbons from the reservoir. Flow from an outlet valve of the production tree is normally connected to a distribution network of midstream facilities, such as tanks, pipelines and transport vehicles, which transport the production to downstream facilities, such as refineries and export terminals.

The various stages of developing a hydrocarbon well often include challenges that are addressed to successfully develop the well. For example, during the drilling stage a well operator may have to monitor and control a drilling operation to ensure that drilling is advancing in a suitable trajectory, and it is not experiencing issues that may jeopardize the drilling of the wellbore or the overall success of the well.

SUMMARY

Monitoring operations of a hydrocarbon well can be important to successfully and efficiently develop a hydrocarbon well. For example, it can be important for a driller to identify characteristics and phases of an ongoing drilling operation so that the driller can make timely and appropriate adjustments in the drilling operation. A drilling rig for a hydrocarbon well may include a number of sensors attached to drilling tools that sense drilling conditions. The sensed data may be used by a well operator, such as a driller, to monitor drilling operation safety and progress.

In some instances, a driller may identify characteristics of a drilling operation, such as classifications (or "phases") of the drilling operation, based on data acquired during the drilling operation, identify drilling parameters corresponding to the characteristics, and control the drilling operation in accordance with the drilling parameters identified. This may include, for example, modifying a mud weight, a mud flow rate, a weight on the drill bit, or a rotational speed of the drill string, or stopping or starting a particular phase of drilling. Unfortunately, interpreting the data acquired during a drilling operation can be challenging and time consuming, which can lead to inaccuracies and delays in identifying characteristics of the drilling operation. Inaccuracies may inhibit the ability to rely on determinations, such as identified drilling classifications. Delays may inhibit the ability to identify and employ drilling parameters in a timely manner, even when drilling characteristics are correctly identified.

In some embodiments, provided is are systems and methods for monitoring and operating a hydrocarbon well drilling operation. Embodiments may provide for accurate and timely identification of drilling characteristics, including drilling classifications. The identified characteristics may be used, for example, to identify drilling parameters corresponding to the characteristics and control drilling operations in accordance with the drilling parameters identified, in real-time. Such a system may enable a driller to take a proactive approach to monitoring and controlling drilling operations.

Provided in some embodiments is a method of drilling a hydrocarbon well that includes the following: conducting a hydrocarbon well drilling operation including a drill bit boring a wellbore in a subsurface formation; collecting drilling operation data, the drilling operation data including characteristics of the hydrocarbon well drilling operation sensed by drilling sensors over a timespan; determining, based on the drilling operation data, drilling operation conditions, the drilling operation conditions including conditions of the hydrocarbon well drilling operation for instants of time within the timespan; determining, based on application of the drilling operation conditions to a well decision tree for identifying classifications of the hydrocarbon well drilling operation, preliminary operation classifications, the preliminary operation classifications identifying a preliminary classification of the hydrocarbon well drilling operation for respective instants of time within the timespan; determining, based on application of a majority voting operation to the preliminary operation classifications, a series of operation classifications for the hydrocarbon well drilling operation, each of the operation classifications indicating a determined classification for a respective instant of time within the timespan; determining, based on the series of operation classifications for the hydrocarbon well drilling operation, a change of operation classifications within the series of operation classifications for the hydrocarbon well drilling operation; conducting, in response to determining the change of operation classifications, a change point detection operation to identify a time of the change of operation classifications; generating drilling operation characteristic data indicating the time of the change of operation classifications; and conducting the hydrocarbon well drilling operation in accordance with the time of the change of operation classifications.

In some embodiments, the drilling operation data includes drilling data records, and each drilling data record is associated with an instant of time of the instants of time and includes a timestamp corresponding to the instant of time and drilling characteristics corresponding to the instant of time. In some embodiments, the drilling characteristics include a mud flow rate, a hook load, a hook height, a hole depth, a bit depth, a rotational speed of the drill string, and a weight on bit. In some embodiments, a drilling operation condition for a given instant of time is determined based on comparison of a first set of sensed characteristics within a first time segment preceding the given instant of time to a second set of sensed characteristics within a second time segment following the given instant of time. In some embodiments, the first set of sensed characteristics includes bit depths for the first time segment, the second set of sensed characteristics include bit depths for the second time segment, and the drilling operation conditions include: a bit plus condition that indicates whether a bit depth value for the given instant of time is greater than a minimum bit depth of the bit depths for the first time segment and is less than a maximum bit depth of the bit depths for the second time segment; and a bit minus condition that indicates whether the bit depth value for the given instant of time is less than a maximum bit depth of the bit depths for the first time segment and is greater than a minimum bit depth of the bit depths for the second time segment. In some embodiments, the method includes determining, for the hydrocarbon well drilling operation, the well decision tree, where a first leaf of the well decision tree considers the bit plus condition and a second leaf of the well decision tree considers the bit minus condition. In some embodiments, the majority voting operation includes: for each of a series of time segments within the timespan: determining a preliminary operation classification having the highest frequency within the time segment; and associating the preliminary operation classification determined as the operation classification for the time segment, where the series of operation classifications for the hydrocarbon well drilling operation includes the operation classifications for the time segment. In some embodiments, the change of operation classifications within the series of operation classifications includes a change in classifications for consecutive operation classifications of the series of operation classifications. In some embodiments, the change point detection operation includes, for each position of a sliding window of time across a candidate timespan containing a time associated with the change of operation classifications within the series of operation classifications: determining a first frequency of classifications in a first sub-window within the sliding window, the first sub-window including a first portion of the sliding window associated with a first time segment; determining a second frequency of classifications in a second sub-window within the sliding window, the second sub-window including a second portion of the sliding window associated with a second time segment adjacent the first time segment; and determining a classification divergence including a divergence between the first frequency of classifications in the first sub-window and the second frequency of classifications in the second sub-window, where the change point includes an instant of time associated with the highest classification divergence of the classification divergences determined for the positions of the sliding window across the candidate timespan. In some embodiments, the drilling operation characteristic data includes operation records that each include an operation type, a start time, a stop time, a start bit depth, a start hole depth, a stop bit depth, and a stop hole depth, where one of the operation records includes an operation type including a first classification and a stop time associated with the time of change, and a next of the operation records of the records includes an operation type including a second classification and a start time associated with the time of change, and where the first classification is different from the second classification. In some embodiments, conducting the hydrocarbon well drilling operation in accordance with the time of the change of operation classifications includes: identifying drilling operation parameters based on the time of the change of operation classifications; and conducting the drilling operation in accordance with the drilling operation parameters.

Provided in some embodiments is a hydrocarbon well drilling system that includes the following: a drilling system adapted to conduct a hydrocarbon well drilling operation including a drill bit boring a wellbore in a subsurface formation, and including drilling sensors; a well control system adapted to perform the following operations: collecting drilling operation data, the drilling operation data including characteristics of the hydrocarbon well drilling operation sensed by the drilling sensors over a timespan; determining, based on the drilling operation data, drilling operation conditions, the drilling operation conditions including conditions of the hydrocarbon well drilling operation for instants of time within the timespan; determining, based on application of the drilling operation conditions to a well decision tree for identifying classifications of the hydrocarbon well drilling operation, preliminary operation classifications, the preliminary operation classifications identifying a preliminary classification of the hydrocarbon well drilling operation for respective instants of time within the timespan; determining, based on application of a majority voting operation to the preliminary operation classifications, a series of operation classifications for the hydrocarbon well drilling operation, each of the operation classifications indicating a determined classification for a respective instant of time within the timespan; determining, based on the series of operation classifications for the hydrocarbon well drilling operation, a change of operation classifications within the series of operation classifications for the hydrocarbon well drilling operation; conducting, in response to determining the change of operation classifications, a change point detection operation to identify a time of the change of operation classifications; generating drilling operation characteristic data indicating the time of the change of operation classifications; and controlling the drilling system to conduct the hydrocarbon well drilling operation in accordance with the time of the change of operation classifications.

In some embodiments, the drilling operation data includes drilling data records, and each drilling data record is associated with an instant of time of the instants of time and includes a timestamp corresponding to the instant of time and drilling characteristics corresponding to the instant of time. In some embodiments, the drilling characteristics include a mud flow rate, a hook load, a hook height, a hole depth, a bit depth, a rotational speed of the drill string, and a weight on bit. In some embodiments, a drilling operation condition for a given instant of time is determined based on comparison of a first set of sensed characteristics within a first time segment preceding the given instant of time to a second set of sensed characteristics within a second time segment following the given instant of time. In some embodiments, the first set of sensed characteristics includes bit depths for the first time segment, the second set of sensed characteristics include bit depths for the second time segment, and the drilling operation conditions include: a bit plus condition that indicates whether a bit depth value for the given instant of time is greater than a minimum bit depth of the bit depths for the first time segment and is less than a maximum bit depth of the bit depths for the second time segment; and a bit minus condition that indicates whether the bit depth value for the given instant of time is less than a maximum bit depth of the bit depths for the first time segment and is greater than a minimum bit depth of the bit depths for the second time segment. In some embodiments, the method includes determining, for the hydrocarbon well drilling operation, the well decision tree, where a first leaf of the well decision tree considers the bit plus condition and a second leaf of the well decision tree considers the bit minus condition. In some embodiments, the majority voting operation includes: for each of a series of time segments within the timespan: determining a preliminary operation classification having the highest frequency within the time segment; and associating the preliminary operation classification determined as the operation classification for the time segment, where the series of operation classifications for the hydrocarbon well drilling operation includes the operation classifications for the time segment. In some embodiments, the change of operation classifications within the series of operation classifications includes a change in classifications for consecutive operation classifications of the series of operation classifications. In some embodiments, the change point detection operation includes, for each position of a sliding window of time across a candidate timespan containing a time associated with the change of operation classifications within the series of operation classifications: determining a first frequency of classifications in a first sub-window within the sliding window, the first sub-window including a first portion of the sliding window associated with a first time segment; determining a second frequency of classifications in a second sub-window within the sliding window, the second sub-window including a second portion of the sliding window associated with a second time segment adjacent the first time segment; and determining a classification divergence including a divergence between the first frequency of classifications in the first sub-window and the second frequency of classifications in the second sub-window, where the change point includes an instant of time associated with the highest classification divergence of the classification divergences determined for the positions of the sliding window across the candidate timespan. In some embodiments, the drilling operation characteristic data includes operation records each include an operation type, a start time, a stop time, a start bit depth, a start hole depth, a stop bit depth, and a stop hole depth, where one of the operation records includes an operation type including a first classification and a stop time associated with the time of change, and a next of the operation records of the records includes an operation type including a second classification and a start time associated with the time of change, and where the first classification is different from the second classification. In some embodiments, controlling the drilling system to conduct the hydrocarbon well drilling operation in accordance with the time of the change of operation classifications includes: identifying drilling operation parameters based on the time of the change of operation classifications; and controlling the drilling system to conduct the drilling operation in accordance with the drilling operation parameters.

Provided in some embodiments is a non-transitory computer readable storage medium including program instructions stored thereon that are executable by a processor to perform the following operations for drilling a hydrocarbon well: collecting drilling operation data for a hydrocarbon well drilling operation including a drill bit boring a wellbore in a subsurface formation, the drilling operation data including characteristics of the hydrocarbon well drilling operation sensed by drilling sensors over a timespan; determining, based on the drilling operation data, drilling operation conditions, the drilling operation conditions including conditions of the hydrocarbon well drilling operation for instants of time within the timespan; determining, based on application of the drilling operation conditions to a well decision tree for identifying classifications of the hydrocarbon well drilling operation, preliminary operation classifications, the preliminary operation classifications identifying a preliminary classification of the hydrocarbon well drilling operation for respective instants of time within the timespan; determining, based on application of a majority voting operation to the preliminary operation classifications, a series of operation classifications for the hydrocarbon well drilling operation, each of the operation classifications indicating a determined classification for a respective instant of time within the timespan; determining, based on the series of operation classifications for the hydrocarbon well drilling operation, a change of operation classifications within the series of operation classifications for the hydrocarbon well drilling operation; conducting, in response to determining the change of operation classifications, a change point detection operation to identify a time of the change of operation classifications; generating drilling operation characteristic data indicating the time of the change of operation classifications; and controlling a drilling system to conduct the hydrocarbon well drilling operation in accordance with the time of the change of operation classifications.

BRIEF DESCRIPTION OF THE DRAWINGS

FIG. 2 is a diagram that illustrates an example process flow for identification of drilling characteristics in accordance with one or more embodiments.

FIG. 4 is a diagram that illustrates a data flow in accordance with one or more embodiments.

FIG. 5B is a table that illustrates operation classifications in accordance with one or more embodiments.

Figure 1:
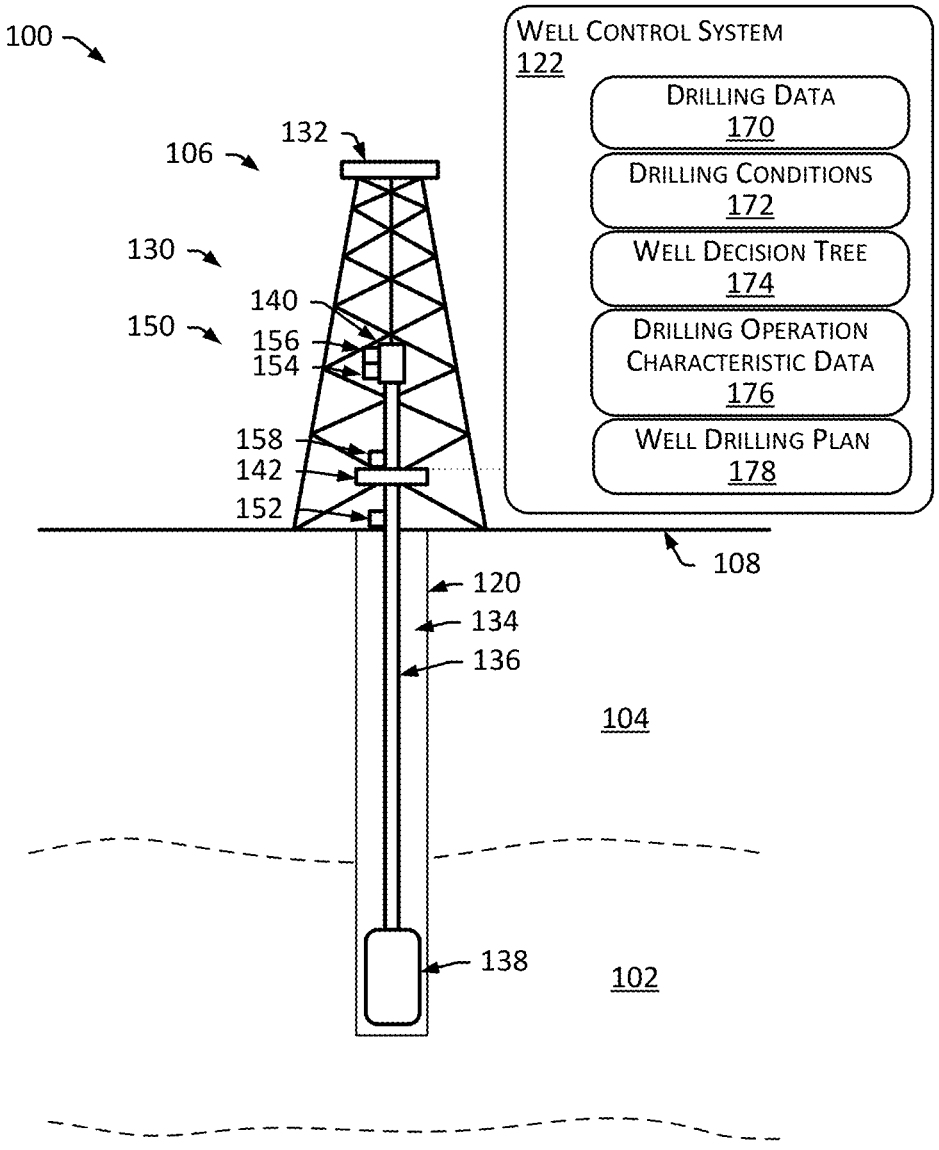
FIG. 1 is diagram that illustrates a well environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the scope of the present disclosure as defined by the claims.

DETAILED DESCRIPTION

Described are embodiments of novel systems and methods for monitoring and operating a hydrocarbon well drilling operation. In some embodiments, the described systems and provide for accurate and timely identification of drilling characteristics, including drilling classifications. The identified characteristics may be used, for example, to identify drilling parameters corresponding to the characteristics and control drilling operations in accordance with the drilling parameters identified, in real-time. Such a system may enable a driller to take a proactive approach to monitoring and controlling drilling operations.

In some embodiments, drilling data for a well drilling operation is obtained (e.g., from drilling sensors), drilling operation conditions are determined based on the drilling data, and drilling operation characteristics, including classifications for different segments of the drilling operation, are determined based on the drilling operation conditions determined. In certain embodiments, the classifications are determined based on application of the drilling operation conditions to a well decision tree to identify "preliminary" drilling operation classifications, and the preliminary drilling operation classifications are applied to a majority voter operation to identify "actual" operation classifications for the drilling operation. In some embodiments, in response to identifying a change in the actual operational classifications for the drilling operation, the drilling data associated with an estimated time of change between classifications is subjected to a change point detection operation to precisely identify a time of transition between the classifications, and drilling operation characteristic data is generated based on the time of change identified. In certain embodiments, the identified characteristics may be used, for example, to identify drilling parameters corresponding to the characteristics in real-time, and drilling operations may be controlled in accordance with the drilling parameters identified. Such a system may enable a driller to take a proactive approach to monitoring and controlling drilling operations.

Although certain embodiments are described in the context of developing hydrocarbon wells, the techniques described may be applied in other context, such as in the development of water wells and other types of wells. Moreover, although certain embodiments are described in the context of well drilling operations, the techniques described may be applied in other context, such as well workover operations, or other well activities involving a rig.

FIG. 1 is a diagram that illustrates a well environment 100 in accordance with one or more embodiments. In the illustrated embodiment, the well environment 100 includes a reservoir ("reservoir") 102 located in a subsurface formation ("formation") 104, and a well system ("well") 106.

The formation 104 may include a porous or fractured rock formation that resides underground, beneath the Earth's surface (or "surface") 108. The reservoir 102 may be a hydrocarbon reservoir, and the well 106 may be a hydrocarbon well, such as an oil well. In the case of the well 106 being a hydrocarbon well, the reservoir 102 may be a hydrocarbon reservoir defined by a portion of the formation 104 that contains (or that is at least determined to or expected to contain) a subsurface pool of hydrocarbons, such as oil and gas. The formation 104 and the reservoir 102 may each include different layers of rock having varying characteristics, such as varying degrees of permeability, porosity, and fluid saturations. In the case of the well 106 being operated as a production well, the well 106 may facilitate the extraction of hydrocarbons (or "production") from the reservoir 102. In the case of the well 106 being operated as an injection well, the well 106 may facilitate the injection of substances, such as gas or water, into the reservoir 102. In the case of the well 106 being operated as a monitoring well, the well 106 may facilitate the monitoring of various characteristics of the formation 104 or the reservoir 102, such as reservoir pressure or saturation.

The well 106 may include a wellbore 120, a well control system (or "control system") 122 and a drilling system 130. The control system 122 may control various operations of the well 106, such as well drilling or workover operations, well completion operations, well production operations, or well and formation monitoring operations. In some embodiments, the control system 122 includes a computer system that is the same as or similar to that of computer system 1000 described with regard to at least FIG. 8.

During drilling operations, drilling fluid, such as drilling mud, may be circulated in the wellbore 120. This can provide hydrostatic pressure to support wall of the wellbore 120, to prevent formation fluids from flowing into the wellbore 120, to cool and clean a drill bit, and to carry drill cuttings away from a drill bit and out of the wellbore 120. During a well logging operation, a logging tool may be lowered into the wellbore 120 and be operated to measure characteristics of the wellbore 120 as it is moved along a length of the wellbore 120. In some instances, the measurements are recorded in a corresponding well log that provides a mapping of the measurements versus depth in the wellbore 120. During completion operations, various components (e.g., casing or production tubing) may be installed in the wellbore 120, or certain operations (e.g., injection operations including pumping substances into the wellbore 120 to fracture the reservoir 102 or clean the wellbore 120) may be undertaken to make the well 106 ready to produce hydrocarbons. During production operations, a drilling rig used to drill the well 106 may be removed and replaced with a collection of valves (or "production tree") and valves (or "downhole valves") may be installed in the wellbore 120. The valves may be employed to regulate pressure in the wellbore 120, to control production flow from the wellbore 120, or to provide access to the wellbore 120. Flow from an outlet valve of the production tree may be coupled to a distribution network, such as pipelines, storage tanks, and transport vehicles, which are used to transport the production to refineries and export terminals.

The wellbore 120 (or "borehole") may include a bored hole that extends from the surface 108 into a target zone of the formation 104, such as the reservoir 102. An upper end of the wellbore 120, at or near the surface 108, may be referred to as the "up-hole" end of the wellbore 120. A lower end of the wellbore 120, terminating in the formation 104, may be referred to as the "down-hole" end of the wellbore 120. The wellbore 120 may provide for the circulation of drilling fluids during drilling operations, the flow of hydrocarbons (e.g., oil and gas) from the reservoir 102 to the surface 108 during production operations, the injection of substances (e.g., water) into the formation 104 or the reservoir 102 during injection operations, or the communication of monitoring devices (e.g., logging tools) into one or both of the formation 104 and the reservoir 102 during monitoring operations (e.g., during in situ logging operations).

The wellbore 120 may be created, for example, by the drilling system 130 boring the wellbore 120 through the formation 104. In some embodiments, the drilling system 130 includes a drilling rig 132 and a drill string 134. The drill string 134 may include, for example, drill pipe 136 and a drill bit 138. In some embodiments, the drill bit 138 includes a cutting device with rotating teeth that can bore through the formation 104 to create the wellbore 120. The drill pipe 136 may include a series of hollow-cylindrical pipe segments joined together to support the drill bit 138 as it cuts the wellbore 120. In some embodiments, the drill pipe 136 is rotated to cause the rotation of the drill bit 138 for cutting the wellbore 120. Drilling mud may be circulated down the interior of the drill pipe 136 and through the drill bit 138. This may cool and lubricate the drill bit 138 and clean the drill bit 138 of cutting or other debris. The mud may circulate up the annular region between the drill pipe 136 and the walls of the wellbore 120 to the surface 108, where the mud is collected and filtered for possible recirculation. The weight of the mud in the annular region may help to control pressure in the wellbore 120. For example, the weight of the mud may inhibit high pressure formation fluids or gases from traveling through the wellbore 120, to the surface 108. The density (or "weight") of the mud may be varied to effectively control pressure in the wellbore 120. For example, a relatively heavy mud may be circulated to offset relatively high formation fluid pressure in the wellbore 120.

The drilling rig 132 may include various components for operating the drill string 134, such as a hook 140 and a rotary table 142. The hook 140 may provide for raising and lowering the drill string 134. For example, the hook 140 may attach to an upper end of the drill string 134, and may be raised or lowered to raise or lower the drill string 134 or to control the weight acting on the drill bit 138 (or "weight on bit"). The weight on bit may be varied to control the how the drill bit 138 cuts through the formation 104. For example, the weight on bit may be varied to control a rate of penetration of the drill bit 138 through the formation 104. The rotary table (or "turntable") 142 may be a device that provides rotation of the drill string 134. For example, the rotary table 142 may engage the drill pipe 136 and provide a rotational force that causes the drill pipe 136 and the drill bit 138 to rotate. The rotation may be varied to control the how the drill bit 138 cuts through the formation 104. For example, the rotation rate may be varied to control a rate of penetration of the drill bit 138 through the formation 104.

In some embodiments, the drilling system 130 includes drilling sensors 150. Drilling sensors 150 may include one or more sensors that sensing characteristics of the drilling operation. The drilling sensor may provide corresponding drilling operation data (or "drilling data") 170 that is indicative of the characteristics of the drilling operation. For example, the drilling sensors 150 may include a mud flow rate sensor 152, a hook load sensor 154, a hook height sensor 156, or a rotational speed sensor 158. The mud flow rate sensor 152 may include a flow rate sensors that measures a flow rate of drilling fluid circulating in the wellbore 120. This may be, for example, the flow rate of drilling mud being pumped into the drill pipe 136 or circulating out of the wellbore 120, in gallons per minute (Gal/min) or cubic meters ($m^3$/min). The hook load sensor 154 may include a load sensor that measures a force acting on the hook 140. This may be, for example, a weight of the drill string 134 or other components supported by the hook 140, in pounds (lbs) or kilograms (kg). The hook height sensor 156 may include a sensor that measures a height of the hook 140. This may be, for example, a vertical distance (or "height") of the hook 140 above the rotary table 142, in feet (ft) or meters (m). The rotational speed sensor 158 may include a sensor that measures a rotational speed of the drill string 134. This may be, for example, be a rotational speed of the drill pipe 136 at the surface 108 (e.g., at or near the rotary table 142), in revolutions per minute (RPMs).

In some embodiments, the control system 122 stores, or otherwise has access to, the drilling data 170. The drilling data 170 may include mud flow rate data, hook load data, hook height data, hole depth data, bit depth data, rotational speed (of the drill string) data, or weight on bit data, for the well 106. Mud flow rate data may indicate the flow rate of drilling fluid circulating in the wellbore 120. The mud flow rate data may be determined based on a mud flow rate sensed by the mud flow rate sensor 152. Hook load data may indicate a measure the weight acting on the hook 140. Hook load data may be determined based on a force sensed by the hook load sensor 154. Hook height data may indicate a measure of a height of the hook 140. Hook height data may be determined based on a height of the hook 140 above the rotary table 142 sensed by the hook height sensor 156. Hole depth data may indicate a depth of the wellbore 120 corresponding to a depth of the bottom of the wellbore 120 from the rotary table 142 (e.g., measured in feet or meters). Hole depth data may be determined by drilling logs identifying the location of the down hole end (or "bottom") of the wellbore 120. Bit depth data may indicate a depth of the drill bit 138, corresponding to a depth of the drill bit 138 in the wellbore 120 from the rotary table 142 (e.g., measured in feet or meters). Bit depth data may be determined by drilling logs identifying the length of the drill string 134 (e.g., the drill pipe 136 and drill bit 138) below the rotary table 142. Rotational speed data may indicate a rotational speed of the drill string 134. Rotational speed data may be determined based on a rotational speed of the drill string 134 (e.g., in RPM) sensed by the rotational speed sensor 158. Weight on bit data may indicate a weight imposed on the drill bit 138 (e.g., measured in pounds (lbs) or kilograms (kg)). The weight on bit data may be determined, for example, by calculation of the weight on bit attributable to the weight of the drill string 134 and other components contributing to force acting on the drill bit 138.

In some embodiments, the drilling data 170 includes data that is indicative of various characteristics of the drilling operation at various instants of time across a given timespan. The timespan maybe some or all of the duration of a well drilling operation. The drilling data 170 may include, for each instant of time within a timespan, a "record" that includes a subset of the drilling data and an associated timestamp corresponding to the instant of time. Each record for a given instant of time may include, for example, a timestamp corresponding to the instant of time, and a determined value for each of mud flow rate, hook load, hook height, hole depth, bit depth, rotational speed (of the drill string), or weight on bit, at or near the instant of time. For example, where drilling data 170 for the well 106 is captured every second over a one hour time segment of a drilling operation, the drilling data 170 for the time segment may include 3600 records, with each record including a timestamp and drilling data (e.g., mud flow rate data, hook load data, hook height data, hole depth data, bit depth data, rotational speed (of the drill string) data, or weight on bit data) for a respective second (or "instant") within the hour.

In some embodiments, the control system 122 stores, or otherwise has access to, the drilling operation conditions (or "drilling conditions") 172. The drilling operation conditions 172 may include conditions of the drilling operation determined based on the drilling data 170. The drilling conditions 172 may include a BOB condition, a flow condition, a hkld condition, a wob condition, a rpm condition, a B + + condition and a B − − condition. A BOB condition for a record may be a binary condition, which is true when the absolute difference between hole depth and bit depth is less than or equals 1, for the record, and is false otherwise. A flow condition for a record may be a binary condition, which is true when the flow rate for the record is greater than or equals a constant threshold, and is false otherwise. A hkld condition for a record may be a binary condition, which is true when the hook load for the record is less than a dynamically updated threshold value (δ), and is false otherwise. A wob condition for a record may be a binary condition, which is true if the weight on bit value for the record is a positive number, and is false otherwise. A rpm condition for a record may be a binary condition, which is true if the RPM sensor reading for the record is a positive number, and is false otherwise. A B + + (or "bit plus") condition for a record may be a binary condition, which is true if the bit depth value of for the record is greater than the minimum value in a subset of drilling data preceding the record (or "previous tuple") and is less than the maximum value in a next subset of drilling data following the record (or "next tuple"), and is false otherwise. A B − − (or "bit minus") condition for a record may be a binary condition, which is true if the bit depth value of the record is less than the maximum value in a subset of drilling data preceding the record (or "previous tuple") and is greater than the minimum value in a next subset of drilling data following the record (or "next tuple"), and is false otherwise.

In some embodiments, the control system 122 stores, or otherwise has access to, a well decision tree 174. The well decision tree 174 may specify a rules-based procedure for identifying classifications of a hydrocarbon well drilling operation based on drilling operation conditions. The well decision tree 174 may be predefined, for example, by a well operator, such as a well driller. The well decision tree 174 may include nodes that define rules-based decisions, including a root node, branch nodes and leaf nodes. A decision at each root or branch node may be defined, for example, based on application of drilling operation conditions to a rule associated with the node, and the decision may define the path (or "branch") to the next node, ultimately leading to a leaf node that defines an outcome (or "decision"). An example well decision tree 174 is discussed in more detail below with regard to at least FIG. 5.

In some embodiments, the control system 122 generates, stores, or otherwise has access to, drilling operation characteristic data (or "output data") 176. The drilling operation characteristic data 176 may include data indicative of various classifications (or "phases") of one or more segments (or "sub-operations") of the drilling operation. For example, the drilling operation characteristic data 176 may include, for each segment of the drilling operation identified for the well 106, a corresponding operation record that includes the following: an operation code, a duration, a start time, an end time, a start hole depth, a start bit depth, an end hole depth, and an end bit depth. An operation code may be a value that identifies the classification (or "phase") of the operation occurring during segment. A duration may be the duration of the segment (e.g., a length of the time defined by the start and end time of the segment). A start time may be the start time of the segment (e.g., a time at the start of the operation associated with the operation record). An end time may be the end time of the segment (e.g., a time at the end of the operation associated with the operation record). A start hole depth may be the hole depth for the well at the start time (e.g., the depth of the wellbore 120 of the well 106 at the start of the operation associated with the operation record). A start bit depth may be the bit depth for the well at the start time (e.g., the depth of the drill bit 138 in the wellbore 120 of the well 106 at the start of the operation associated with the operation record). An end hole depth may be the hole depth for the well at the end time (e.g., the depth of the wellbore 120 of the well 106 at the end of the operation associated with the operation record). An end bit depth may be the bit depth for the well at the end time (e.g., the depth of the drill bit 138 in the wellbore 120 of the well 106 at the end of the operation associated with the operation record).

In some embodiments, the control system 122 stores, or otherwise has access to, a well drilling plan (or "drilling plan") 178. The drilling plan 178 may specify parameters for drilling (or "drilling parameters") of the well 106. The drilling plan 178 may be predefined, for example, by a well operator, such as a well driller. The drilling plan 178 may define a sequence of drilling operation segments to be undertaken to drill the wellbore 120. The drilling plan 178 may define parameters for each drilling operation segment, such as ranges or target values for drilling mud flow rate, hook load, weight on bit, or drill string rotational speed. In some embodiments, the drilling plan 178 includes conditional parameters. For example, the drilling plan 178 may include drilling parameters defining conducting a next drilling operation segment upon completion of a given drilling operation segment, or modifying drilling parameters in response to encountering a given set of drilling conditions. Such conditional parameters may facilitate automation of at least some portions of the drilling operations, which may enable relative fast and appropriate responses to conditions encountered during drilling operations.

In some embodiments, the control system 122 collects (or otherwise obtains) drilling data for a well drilling operation (e.g., obtains drilling data 170 for a drilling operation of the well 106), determines drilling operation conditions (e.g., determines drilling operation conditions 172) based on the drilling data, and determines drilling operation characteristic data (e.g., determines drilling operation characteristic data 176), such as classifications for different segments of the drilling operation, based on the drilling operation conditions determined. In some embodiments, the classifications for the different segments of the drilling operation characteristic data are determined based on application of the drilling operation conditions to a well decision tree (e.g., well decision tree 174) to identify "preliminary" drilling operation classifications, and the preliminary drilling operation classifications are applied to a majority voter operation to identify "actual" operation classifications for the drilling operation. The control system 122 may, in response to identifying a change in actual operational classifications for the drilling operation, apply a change point detection operation to data associated with an estimated time of the change between classifications to precisely identify a time of the transition between the classifications, and generate drilling operation characteristic data (e.g., drilling operation characteristic data 176) based on the time of change identified.

FIG. 2 is a diagram that illustrates an example process flow for identification of drilling characteristics, including drilling classifications, in accordance with one or more embodiments. As illustrated, in some embodiments, drilling data 170 for a drilling operation may be subjected to a decision tree operation, a majority voter learning operation and change point detection operation, such as those described here, to generate drilling operation characteristic data 176. The drilling data 170 may include relatively high-frequency data, such as a stream of records 202 representing respective sets of data (e.g., mud flow rate data, hook load data, hook height data, hole depth data, bit depth data, rotational speed (of the drill string) data, or weight on bit data) sensed every second). The drilling operation characteristic data 176 may include relatively low-frequency data, such as series of operation records 204 that each represent a drilling operation segment. Such low-frequency data may facilitate interpretation and understanding of the drilling operation by an operator. Accordingly, described embodiments may provide for accurate and timely identification of drilling characteristics, including drilling classifications. The identified characteristics may be used, for example, to identify drilling parameters, and drilling operations may be conducted in accordance with the drilling parameters identified, in real-time (e.g., within ten minutes of the time of a classification change taking place). Such a system may enable a driller to take a proactive approach to monitoring and controlling drilling operations.

Figure 3:
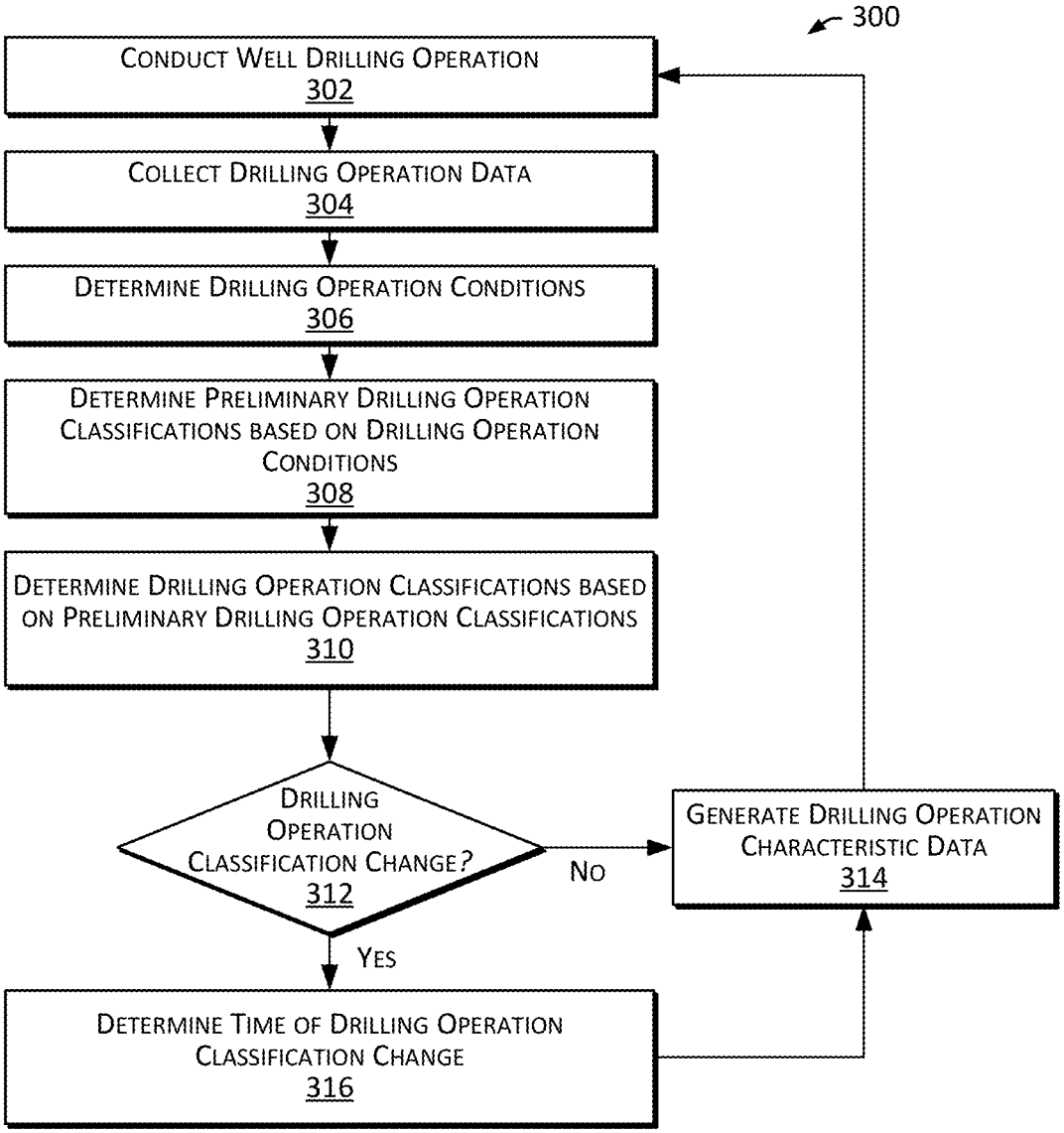
FIG. 3 is a flowchart that illustrates a method of drilling a hydrocarbon well in accordance with one or more embodiments.

FIG. 3 is a flowchart that illustrates a method 300 of drilling a hydrocarbon well in accordance with one or more embodiments. In the context of the well 106, the operations of the method 300 may be performed, for example, by the well control system 122 or another operator of the well 106.

In some embodiments, method 300 includes conducting a hydrocarbon well drilling operation (or "drilling operation") (block 302). Conducting a drilling operation may include operating a drilling system to bore a wellbore into a subsurface formation. For example, conducting a drilling operation may include the well control system 122 (or another operator of the well 106) controlling operation of the drilling system 130 to cause the drill bit 138 to bore the wellbore 120 into the formation 104.

In some embodiments, method 300 includes collecting drilling operation data (or "drilling data") (block 304). Collecting drilling data may include, during the drilling operation, collecting drilling operation data that is indicative of characteristics of the hydrocarbon well drilling operation. For example, collecting drilling data may include the well control system 122 (or another operator of the well 106) collecting the drilling data 170, including data identifying characteristics of the drilling operation that are sensed by the drilling sensors 150 during the drilling of the wellbore 120 into the formation 104. The drilling data may include conditions of the drilling operation for instants of time within the timespan of a portion of the drilling operation. For example, the drilling data 170 may include records 202 identifying mud flow rate, hook load, hook height, hole depth, bit depth, rotational speed (of the drill string), or weight on bit, for the well 106 over a one hour timespan (or "segment") of the drilling of the wellbore 120 into the formation 104. Each of the records 202 may be associated with a respective instants of time. For example, a first record 202 of the drilling data 170 may include a mud flow rate, a hook load, a hook height, a hole depth, a bit depth, a rotational speed, and a weight on bit, for the well 106 at a first instant of time (e.g., 1:00:00) (along with a corresponding first timestamp of 1:00:00), a second record 202 of the drilling data 170 may include a mud flow rate, a hook load, a hook height, a hole depth, a bit depth, a rotational speed, and a weight on bit, for the well 106 at a second instant of time (e.g., 1:00:01) (along with a corresponding second timestamp of 1:00:01), and so forth.

In some embodiments, method 300 includes determining drilling operation conditions (block 306). Determining drilling operation conditions may include determining drilling operation conditions for the drilling operation based on the drilling data collected for the drilling operation. For example, determining drilling operation conditions may include the well control system 122 (or another operator of the well 106) determining the drilling operation conditions for the drilling of the wellbore 120 into the formation 104 based on the drilling data 170. The drilling operation conditions may include conditions of the drilling operation for instants of time within the timespan of the portion of the drilling operation. The drilling conditions may include, for example, a BOB condition, a flow condition, a hkld condition, a wob condition, a rpm condition, a B + + condition and a B − − condition, for the well 106 for each instant of time (e.g., each second) within the one hour timespan (or "segment") of the drilling of the wellbore 120 into the formation 104. For example, a first record of drilling conditions 172 for the first instant of time (e.g., 1:00:00) may include a BOB condition, a flow condition, a hkld condition, a wob condition, a rpm condition, a B + + condition and a B − − condition, for the well 106 determined for the first instant of time (along with a corresponding first timestamp of 1:00:00), a second record of drilling conditions 172 for the second instant of time (e.g., 1:00:01) may include a BOB condition, a flow condition, a hkld condition, a wob condition, a rpm condition, a B + + condition and a B − − condition, for the well 106 determined for the second instant of time (along with a corresponding second timestamp of 1:00:01), and so forth.

In some embodiments, the determination of the hkld condition for an instant of time requires determination of a dynamically updated hook load threshold value (δ) for the instant of time. For example, as noted above the hkld condition may be a binary condition, which is true when the hook load is less than a dynamically updated threshold value (δ), and is false otherwise. The dynamically updated threshold value (δ) may indicate a hook load with no drill string attached to the hook. In some embodiments, the dynamically updated hook load threshold value (δ) for a given instant of time is determined based on a the hook load values of prior records of drilling data that meet conditions relating to bit depth and hook height. For example, the dynamically updated hook load threshold value (δ) for a given instant of time may be determined as follows: (1) identify the most recent two-hundred records 202 of drilling data 170 associated with instants of time before the given instant of time in which, for each record 202 (a) the difference between the bit depth in the record 202 and the bit depth in a record 202 immediately preceding the record 202 is zero; and (b) the absolute difference between the hook height in the record 202 and the hook height in a record 202 immediately preceding the record 202 is greater than one; (2) determine the mean (μ) and the standard deviation (σ) for hook load values of the most recent two-hundred records 202 of drilling data 170 that satisfy conditions (a) and (b); and (3) calculate the dynamically updated hook load threshold value (δ) according to the following relationship:

$$\delta=\mu+2*\sigma \tag{1}$$

In some embodiments, if there are not enough records satisfying the conditions, a default hook load threshold value (δ) may be used (e.g., 6=90 lbs). In some embodiments, the dynamically updated hook load threshold value (δ) may be calculated for each instant of time (e.g., for each record 202 generated in the drilling data 170). In some embodiments, the dynamically updated hook load threshold value (δ) may be calculated and updated periodically (e.g., hourly) or in response to a given event (e.g., in response to determining classification change in drilling operations).

In some embodiments, the B + + condition and the B – – condition for an instant of time are based on subsets of drilling data (or "tuples") for timespans before and after the instant of time. For example, referring to FIG. 4 drilling data 170 may be written sequentially into a first buffer (A) in computer memory. The first buffer (A) may have a first buffer segment (a.1), a second buffer segment (a.2), and a third buffer segment (a.3). The first buffer (A) may be a first-in-first-out (FIFO) buffer in which data written into the buffer moves sequentially through the segments of the first buffer (A) as data is written into the buffer segment (a.1). For example first, second, and third records 202 of drilling data 170 associated with times 0:00:01, 0:00:02, and 0:00:03 may be written to the first buffer first segment (a.1) in sequence, sequentially move into and out of the second buffer segment (a.2) in sequence, and into, through and out of the third buffer segment (a.3) in response to "new" data associated with more recent instants of time (e.g., records 202 of drilling data 170 associated with times 0:01:10, 0:01:11, and 0:01:12) being written into the first buffer segment (a.1). Accordingly, the first buffer (A) may effectively hold a moving window of the drilling data 170. In some embodiments, the drilling data 170 is provided in well site information transfer standard markup language (WITSML) format.

The second buffer segment (a.2) may hold a single record 202 for a given instant of time that occurs before the instants of time associated with the records 202 in the first buffer segment (a.1) and after the instants of time associated with the records in the third buffer segment (a.3). Each of the first and third buffer segments (a.1 and a.3) may have at least a given number of records 202 of drilling data 170 (e.g., at least three records 202 of drilling data 170) covering at least a given span of time (e.g., covering 15 seconds or more). The first and third buffer segments (a.1 and a.3) may be of the same or different lengths (e.g., they may hold the same or different numbers of records 202 of drilling data 170) and may cover the same or different lengths of time.

In some embodiments, values for the B + + condition and the B – – condition for a given instant of time associated with the record 202 currently in the second buffer segment (a.2) are based on subsets of drilling data (or "tuples") which are present in the buffer first segment (a.1) (associated with instants of time after the instant of time) and which are present in the third buffer segment (a.3) (associated with instants of time before the instant of time). For example, for a given record 202 (associated with a given instant of time) currently in the second buffer segment (a.2), the maximum and the minimum of the bit depths of the records 202 in the first buffer segment (a.1) may be determined, and the maximum and the minimum of the bit depths of the subsets of the records 202 in the third buffer segment (a.3) may be determined. The B + + condition for the given record 202 (and the given instant of time) may be determined as "true" if the bit depth value of the record 202 in the second buffer segment (a.2) is greater than the minimum value of the bit depths of the records 202 in the third buffer segment (a.3) and is less than the maximum value of the bit depths of the records 202 in the first buffer segment (a.1), and if not, the B + + condition for the given record 202 (and the given instant of time) may be determined as "false." The B – – condition for the given record 202 (and the given instant of time) may be determined as "true" if the bit depth value of given record 202 in the second buffer segment (a.2) is less than the maximum value of the bit depths of the records 202 in the third buffer segment (a.3) and is greater than the minimum value in the bit depths of the records 202 in the first buffer segment (a.1), and if not, the B – – condition for the given instant of time may be determined as "false." The values for the B ++ condition and the B – – condition for a given record 202 (and the given instant of time associated with the record 202) currently in the second buffer segment (a.2) may be used in combination with other drilling operation conditions 172 for the given record 202 (and the given instant of time) to determine a preliminary classification for the instant of time (e.g., using a well decision tree operation, as described here with regard to at least block 308). As described here, the preliminary classifications determined may be written to a second buffer (B), and be used determine a series of operation classifications for the drilling operation (e.g., based on a majority voting operation), as described with regard to at least block 310.

In some embodiments, method 300 includes determining preliminary drilling operation classifications based on the drilling operation conditions (block 308). Determining preliminary drilling operation classifications based on the drilling operation conditions may include determining, based on application of the drilling operation conditions to a well decision tree, preliminary operation classifications that identify a preliminary classification of the drilling operation for respective instants of time within the timespan of a portion of the drilling operation. For example, determining preliminary drilling operation classifications based on the drilling operation conditions may include the well control system 122 (or another operator of the well 106) determining, based on application of the drilling conditions 172 (for the drilling of the wellbore 120 into the formation 104) to the well decision tree 174, preliminary operation classifications that identify a preliminary classification of the drilling operation for respective instants of time within the timespan of the portion of the drilling of the wellbore 120 into the formation 104. For example, application of the drilling conditions 172 to the well decision tree 174 may identify the drilling classifications of CD1, CD2, CD1 and so forth.

Figure 5A:
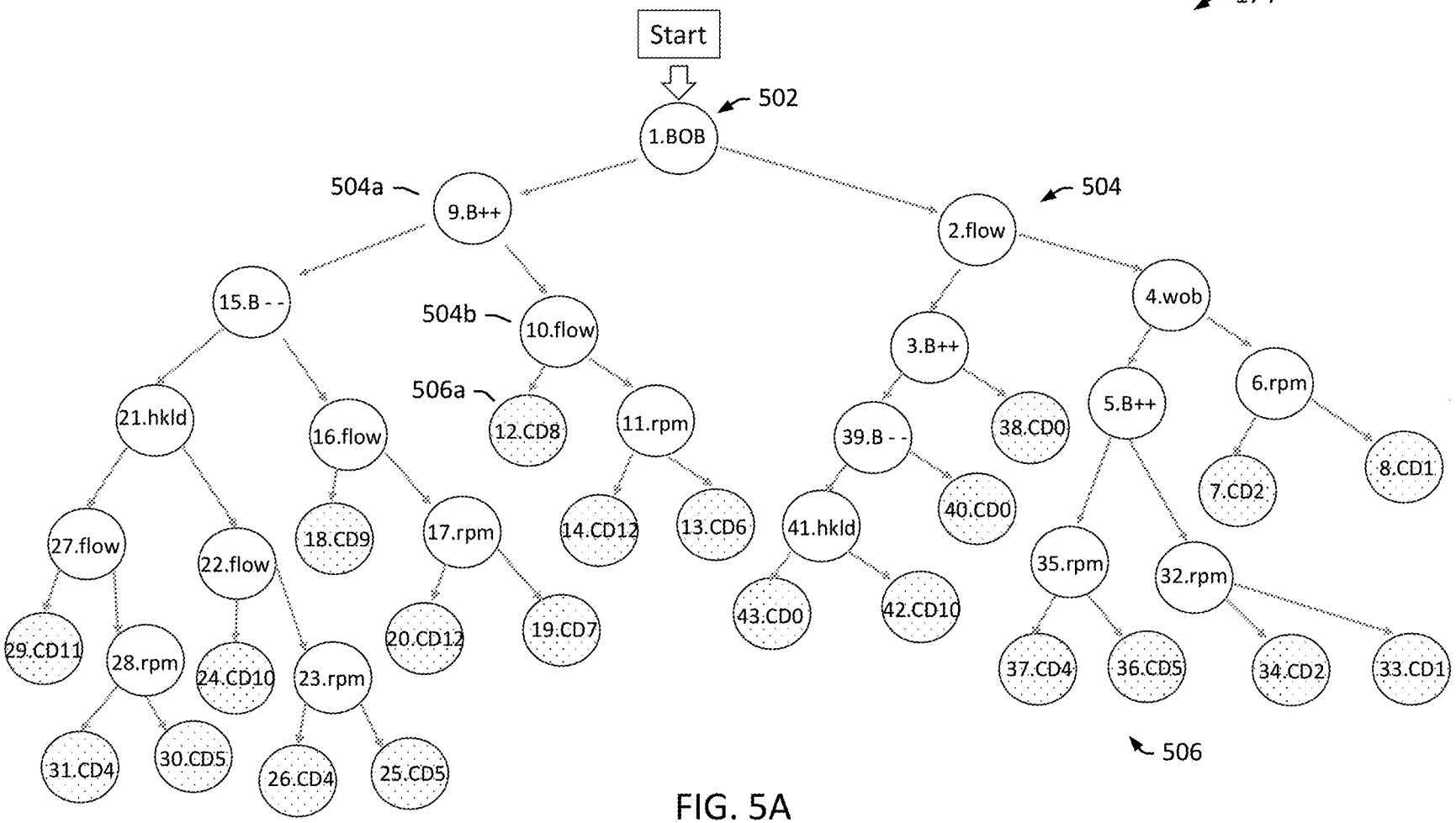
FIG. 5A is a diagram that illustrates a well decision tree in accordance with one or more embodiments.

FIG. 5A is a diagram that illustrates an example well decision tree 174 in accordance with one or more embodiments. In the illustrated embodiment, the well decision tree 174 includes a root node 502 (one in total), branch nodes 504 (20 in total) and leaf nodes 506 (22 in total, identified with hatching) defining rules-based decisions. A decision at each of the root node 502 and branch nodes 504 may be defined, for example, based on application of drilling operation conditions to a rule associated with the node, and the decision may define the path (or "branch" to the next node, ultimately leading to a leaf node 506 defining an outcome (or "end decision"). In the illustrated embodiment, in response to a rule of the root node 502 or a branch node 504 being satisfied (e.g., a true condition), the well decision tree operation proceeds to branch "right" to a next node. In response to a rule of the root node 502 or a branch node 504 being unsatisfied (e.g., a false condition), the well decision tree operation proceeds to a branch "left" to a next node. This is repeated until iteratively through the "tree" until a leaf node 506 is encountered, which defines a drilling classification to be associated with the subset of drilling conditions being assessed. For example, where drilling conditions 172 for a given instant of time (e.g., 1:01:11) indicate the following: BOB=false, flow=false, hkld=true, wob=true, rpm=true, a B + +=true, and a B – –=false, the well decision tree operation for that instant of time may include branching left from the root node 502 to branch node "9" 504*a*, and branching right from branch node "9" 504*a* to branch node "10" 504*b*, and branching left from branch node "10" 504*b* to leaf node "12" 506*a* which is associated with a classification of "CD8" (or a "tripping in" classification). As a result, the drilling operation may be determined to have a classification of CD8 at the given instant of time (e.g., 1:01:11). A similar well decision tree operation may be repeated for each instant of time using the drilling operation conditions associated with the respective instant of time, to determine a classification for each instant of time. FIG. 5B is a table that illustrates operation classifications in accordance with one or more embodiments.

In some embodiments, method 300 includes determining a series of operation classifications for the drilling operation (block 310). Determining a series of operation classifications for the drilling operation may include determining, based on application of the preliminary drilling operation classifications determined to a majority voter operation, operation classifications for the drilling operation, with each of the operation classifications indicating a determined classification for a respective instant of time within the timespan for the drilling operation. For example, determining a series of operation classifications for the drilling of the wellbore 120 into the formation 104 may include the well control system 122 (or another operator of the well 106) determining, based on application of the preliminary drilling operation classifications determined to a majority voter operation, operation classifications for the drilling of the wellbore 120 into the formation 104, with each of the operation classifications indicating a determined classification for a respective instant of time within the timespan of the portion of the drilling of the wellbore 120 into the formation 104. In an example embodiment, the series of classifications for the timespan may indicate a series of the same classifications across the timespan, such as [CD1, CD1, CD1 . . . CD1, CD1, CD1] which indicates that the drilling operation has remained in the same classification of "rotary drilling" across the timespan. In an example embodiment, the series of classifications for the timespan may indicate a series having at least two different classifications across the timespan, such as [CD1, CD1, CD1 . . . CD1, CD1, CD2] which indicates that the drilling operation has changed from the classification of "rotary drilling" to "slide" drilling in the corresponding timespan.

In some embodiments, the classification for an instant of time is determined based on subsets (or "tuples") of classifications for timespans before and after the instant of time. For example, referring to FIG. 4, as classifications for the instant of times associated with the records 202 in (a.2) are sequentially determined, the determined classifications may be sequentially written to the second buffer (B) in computer memory, where adjacent subsets (or "tuples") of classifications are assessed to identify a classification for each of the respective subsets, and the classifications for the subsets are compared to determine if there has been a change of classifications between the subsets. The second buffer (B) may have a first segment (b.3), a second segment (b.2), and a third segment (b.1). The second buffer (B) may be a first-in-first-out (FIFO) buffer in which data written into the first segment (b.3) moves sequentially through the first segment (b.3), the second segment (b.2), and the third segment (b.1) as "new" data is written into the first buffer segment (b.3). For example first, second, and third classifications associated with times 0:00:01, 0:00:02, and 0:00:03 may be written in the first segment (b.3) in sequence, sequentially move into, through and out of the second buffer segment (b.2) in sequence, and into, through and out of the third buffer segment (b.1) as "new" classifications associated with more recent instants of time (e.g., classifications associated with times 0:01:10, 0:01:11, and 0:01:12) are written into the first buffer segment (b.3). Accordingly, buffer (B) may effectively hold a moving window of classifications, with the first, second and third segments (b.3, b.2 and b.1), each holding respective moving windows of classifications.

The first buffer segment (b.3) may hold one or more classifications. Each of the second and third buffer segments (b.2 and b.1) may be relatively large, each holding at least a given number of classifications (e.g., at least 15 sequential classifications) covering at least a given span of time (e.g., covering 15 seconds or more). The second and third buffer segments (b.2 and b.1) may be of the same or different lengths (e.g., they may hold the same or different number of classifications) and may cover the same or different lengths of time. The first buffer segment (b.3) may be the same size or smaller than each of the second and third buffer segments (b.2 and b.1).

Figure 6:
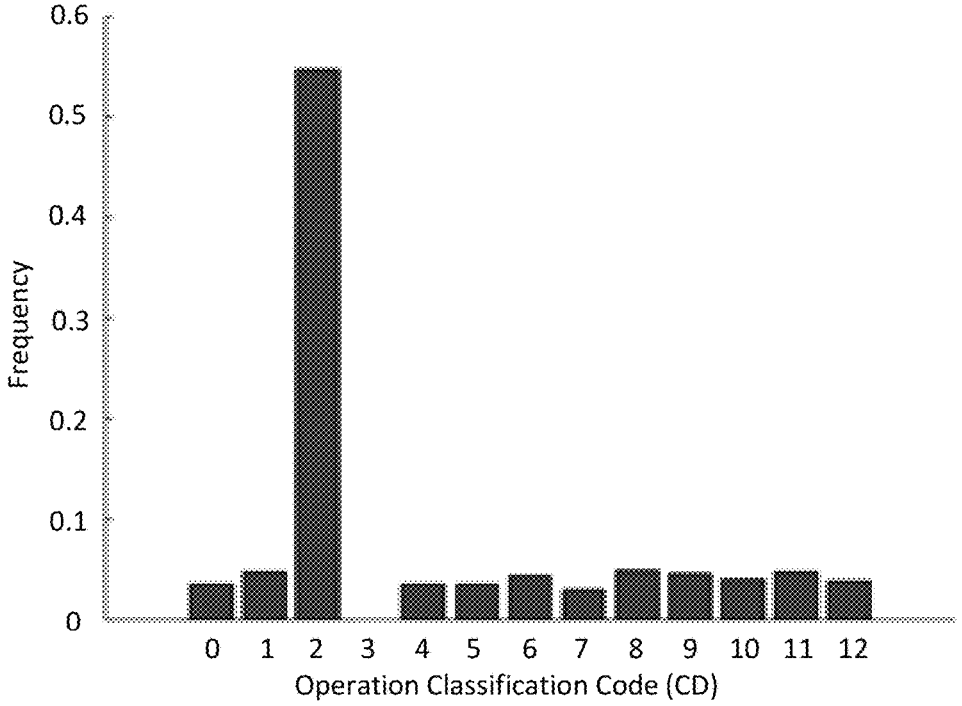
FIG. 6 is a histogram that illustrates a distribution of classifications within a given buffer segment in accordance with one or more embodiments.

In some embodiments, a majority voter operation includes application of a majority voter algorithm to a subset of data to identify a value to be associated with the subset of data. For example, a majority voter algorithm may be applied to each of the second and third buffer segments (b.2 and b.1) to determine a respective classification associated with each of the second and third buffer segments (b.2 and b.1), and the two classifications may be compared to determine whether a classification change has occurred. FIG. 6 is a histogram that illustrates an example distribution of classifications within a given buffer segment in accordance with one or more embodiments. In some embodiments, application of a majority voter algorithm to a buffer segment identifying a series of classifications may identify the classification occurring with the highest frequency in the buffer segment, as the classification to be associated with the "classification tuple" currently contained in the buffer segment. For example, in the illustrated embodiment, the classification associated with operation classification code "2" (e.g., "CD2" or "slide drilling") may be associated with the "classification tuple" currently contained in the buffer segment, based on operation classification code "2" having the highest frequency.

In some embodiments, method 300 includes determining whether a change in drilling operation classifications has occurred (block 312). Determining whether a change in drilling operation classifications has occurred may include determining whether a change in classifications has occurred across the series of operation classifications for the drilling operation. For example, determining whether a change in drilling operation classifications has occurred may include the well control system 122 (or another operator of the well 106) determining whether a change in classifications has occurred across the series of operation classifications for the timespan of the portion of the drilling of the wellbore 120 into the formation 104. Referring to the first of the above examples (having the series of classifications [CD1, CD1, CD1 . . . CD1, CD1, CD1]), it may be determined that a classification change did not occur at any time in the timespan associated with the series of classifications. Referring to the second of the above examples (having the series of classifications [CD1, CD1, CD1 . . . CD1, CD1, CD2]), it may be determined that a classification change did occur within the time segment between the time associated with the last classification of CD1 (e.g., 1:00:00) and the time associated with the classification of CD2 (e.g., 1:00:10).

Referring again to FIG. 4, in some embodiments, each time a new classification is added to the second buffer (B), a majority voter algorithm may be applied to each of the "classification tuples" currently contained in the second and third buffer segments (b.2 and b.1), and the two classifications may be compared to determine whether a classification change has occurred. For example, if for a first given buffer state, application of a majority voter algorithm to the second buffer segment (b.2) identifies a classification of CD1 for the second buffer segment (b.2), and application of a majority voter algorithm to the third buffer segment (b.1) identifies a classification of CD1 for the third buffer segment (b.1), it may be determined that no classification change has occurred. If for a second given buffer state, application of a majority voter algorithm to the second buffer segment (b.2) identifies a classification of CD2 for the second buffer segment (b.2), and application of a majority voter algorithm to the third buffer segment (b.1) identifies a classification of CD1 for the third buffer segment (b.1), it may be determined that a classification change has occurred.

In some embodiments, method 300 includes in response to determining that a change in drilling operation classifications has not occurred, proceeding to generate drilling operation characteristic data (block 314). In some embodiments, method 300 includes in response to determining that a change in drilling operation classifications has occurred proceeding to determining a time of the drilling operation classification change (block 316), and proceeding to generate corresponding drilling operation characteristic data (block 314).

Determining the time of a drilling operation classification change may include identifying a candidate classification change time frame for assessment, and conducting a change point detection operation across the data associated with the candidate change time frame, to identify a time at which the classification change actually occurred. Referring to the above described example for the second given buffer state where application of a majority voter algorithm to the second buffer segment (b.2) identifies a classification of CD2 for the second buffer segment (b.2), and application of a majority voter algorithm to the third buffer segment (b.1) identifies a classification of CD1 for the third buffer segment (b.1), it may be determined that a classification change has occurred, and the time span associated with the classifications in the second and third buffer segments (b.2 and b.1) may be identified as a candidate classification change time frame.

In some embodiments, the candidate classification change time frame is defined as spanning the maximum and minimum times associated with classifications in the second and third buffer segments (b.2 and b.1). The candidate classification change time frame may be defined for example as starting at the time associated with the "oldest" classification in the third buffer segment (b.1) (e.g., the classification that will move out of the third buffer segment (b.1) when the next classification is written into the first buffer segment (b.3)), and ending at the time associated with the "newest" classification in the second buffer segment (e.g., the time associated with the classification most recently shifted from the first buffer segment (b.3) into the second buffer segment (b.2)). If, for example, the oldest classification in the third buffer segment (b.1) is associated with a time of 0:00:00 and the newest classification in the second buffer segment (b.2) is associated with a time of 1:00:10, the candidate classification change time frame may be defined as the time span from 0:00:00 to 1:00:10.

Figure 7:
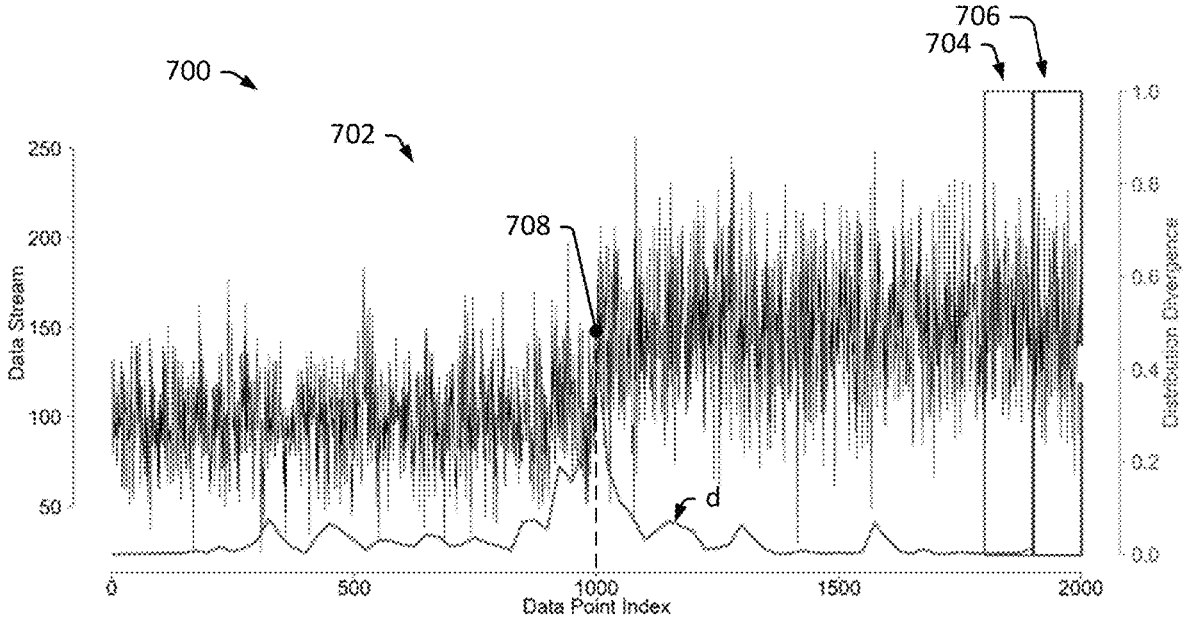
FIG. 7 is a plot that illustrates application of a change point detection operation to drilling data in accordance with one or more embodiments.

In some embodiments, a change point detection operation includes application of a change point detection algorithm to a subset of data to identify a time to be associated with a change within the subset of data. For example, a change point detection operation may be applied to drilling data 170 corresponding to a candidate classification change time frame to identify specifically when the change between classifications occurred. Referring to the above described example including the candidate classification change time frame defined as spanning from 0:00:00 to 1:00:10, a change point detection operation may be applied to records 202 of the drilling data 170 for the instants of time from 0:00:00 to 1:00:10, to identify when the change from classification CD1 to CD2 actually occurred. FIG. 7 is a plot 700 that illustrates application of a change point detection operation to a subset of drilling data 702 in accordance with one or more embodiments. In the illustrated embodiment, the subset of drilling data 702 may include 2000 individual data points spanning the candidate classification change time frame. For example, the first of the 2000 data points may be a record 202 of drilling data 170 corresponding to the time 0:00:00 (e.g., a record 202 of drilling data 170 having a timestamp of 0:00:00), and the last of the 2000 data points may be a record 202 of drilling data 170 corresponding to the time 1:00:10 (e.g., a record 202 of drilling data 170 having a timestamp of 1:00:10). In some embodiments, the drilling data includes a classification value. For example, each point of the drilling data 170 may be a value representing a determined classification for the associated point in time. In some embodiments, the drilling data 170 can include other data of interest, such as other parameter values that are associated with a classification or other characteristic of the operation. The change point detection operation may employ two sliding windows 704 and 706 that consider adjacent subsets of the subset of drilling data. As the sliding windows 704 and 706 are moved in unison across the subset of drilling data 170, for each position of the windows 704 and 706, a corresponding frequency (F) of the classification codes found in each of the windows 704 and 706 and divergence (d) of the frequency (F) of the classification codes for the two windows 704 and 706 is determined. In some embodiments, the change point 708 is determined to occur at the time corresponding to the maximum value of the divergence (d). For example, referring to FIG. 7, the change point 708 may occur at or around the $1000^{th}$ data point (which corresponds to the time 00:30:05). Accordingly, it may be determined that the drilling operation transitioned from "rotary drilling" (associated with classification "CD1") to "slide drilling" (associated with classification "CD2") at the time of 00:30:05.

Generating drilling operation characteristic data (block 314) may include generating drilling operation characteristic data that is indicative of characteristics of the drilling operation through the timespan. For example, generating drilling operation characteristic data may include the well control system 122 (or another operator of the well 106) storing in memory, displaying, or otherwise providing, drilling operation characteristic data 176 that indicates the series of operation classifications for the timespan of the portion of (or all of) the drilling of the wellbore 120 into the formation 104, as well as changes of classifications within the series of operation classifications and instants of time associated therewith. For example, referring to the second of the above examples, drilling operation characteristic data 176 may include the following time-classification pairs, [(0:00:00, CD1), (0:00:10,CD1), (0:00:20,CD1) . . . (0:59:60,CD1), (1:00:00,CD1), CD2, 1:00:10], and the following indication of time classification change [CD1:CD2, 1:00:05] (indicating the instant of drilling operation classification change determined for the change from CD1 to CD2. In some embodiments, the drilling operation characteristic data 176 includes operation records 204 that each represent a drilling operation segment. Each of the drilling operation records may include information about a respective operation segment, including, for example, an operation code, a duration, a start time, an end time, a start hole depth, a start bit depth, an end hole depth and an end bit depth. Continuing with the above example, the drilling operation characteristic data 176 for the well 106 may include a series of operation records 204 that include an operation record 204 having an operation code of "CD1", and an end time of 00:30:05 (indicating a "rotary drilling" phase that ended at 00:30:05) (along with a duration of 30 minutes, a start time of 00:00:05, and start hole depth of 500 ft, a start bit depth of 500 ft, an end hole depth of 520 ft, and an end bit depth of 520 ft), and a next operation record 204 in the sequence having an operation code of "CD2" and a start time of 00:30:05 (indicating a "slide drilling" phase that started at 00:30:05) (along with a duration of 10 minutes, a start time of 00:30:05, and start hole depth of 520 ft, a start bit depth of 520 ft, an end hole depth of 530 ft, and an end bit depth of 530 ft). Based on this data it can be determined that the drilling operation transitioned from a "rotary drilling" phase to a "slide drilling" phase at a time of 00:30:05 (and a depth of 520 ft). The series of operation records 204 may include other records 202 that indicate transitions between the drilling phases, and characteristics of the respective phases.

In some embodiments, operations may be conducted based on drilling operation characteristic data. For example, drilling parameters for the well 106 may be identified based on the drilling operation classifications (and other data of the operation records) and changes thereof identified in the drilling operation characteristic data 176, and the well 106 may be operated in accordance with the drilling parameters. This may include, for example, the well control system 122 (or another operator of the well 106), in response to determining that a drilling operation for the well 106 has transitioned from "rotary drilling" (associated with classification "CD1") to "slide drilling" (associated with classification "CD2"), identifying a mud weight, a mud circulation rate, a weight on bit, drill string or a rotational speed identified in the drilling plan 178 for slide drilling, and conducting a subsequent portion of the drilling operation in accordance with the mud weight, the mud circulation rate, the weight on bit, the drill string or the rotational speed identified. This may enable an operator, such as a driller, to take a proactive approach to identifying and employing appropriate drilling parameters.

Figure 8:
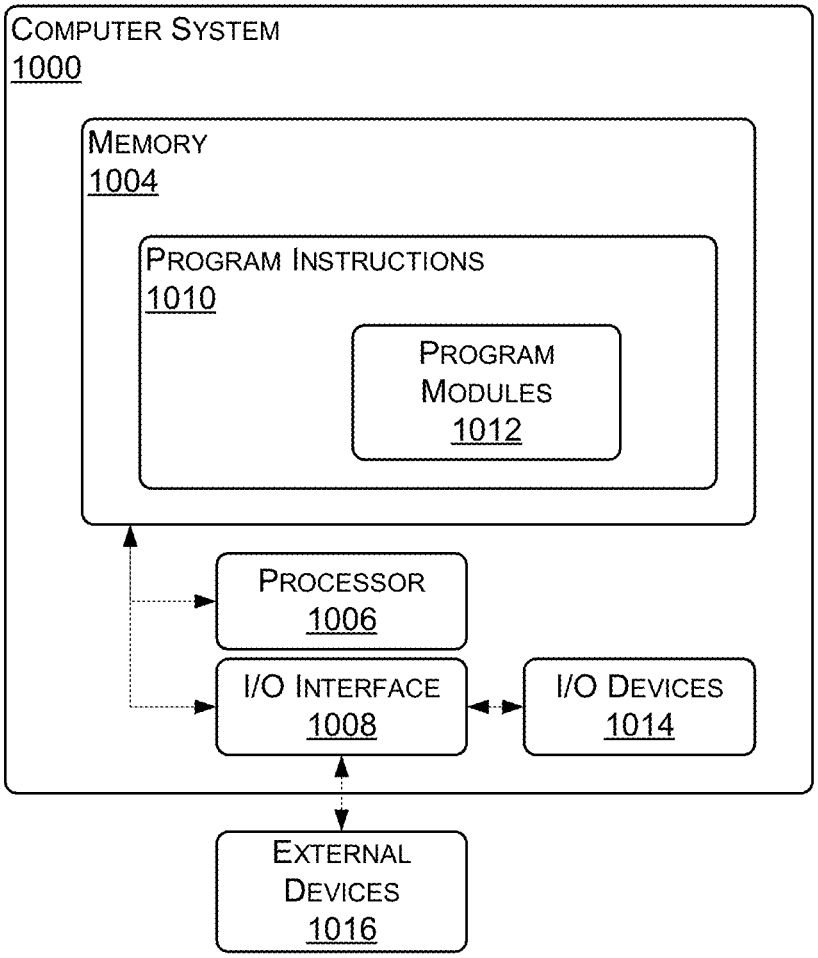
FIG. 8 is a diagram that illustrates an example computer system in accordance with one or more embodiments.

FIG. 8 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include non-volatile memory (e.g., flash memory, read-only memory (ROM), programmable read-only memory (PROM), erasable programmable read-only memory (EPROM), electrically erasable programmable read-only memory (EEPROM)), volatile memory (e.g., random access memory (RAM), static random access memory (SRAM), synchronous dynamic RAM (SDRAM)), or bulk storage memory (for example, CD-ROM or DVD-ROM, hard drives). The memory 1004 may include a non-transitory computer-readable storage medium having program instructions 1010 stored thereon. The program instructions 1010 may include program modules 1012 that are executable by a computer processor (e.g., the processor 1006) to cause the functional operations described, such as those described with regard to the well control system 122 (or another operator of the well 106) or the method 300.

The processor 1006 may be any suitable processor capable of executing program instructions. The processor 1006 may include a central processing unit (CPU) that carries out program instructions (e.g., the program instructions of the program modules 1012) to perform the arithmetical, logical, or input/output operations described. The processor 1006 may include one or more processors. The I/O interface 1008 may provide an interface for communication with one or more I/O devices 1014, such as a joystick, a computer mouse, a keyboard, or a display screen (for example, an electronic display for displaying a graphical user interface (GUI)). The I/O devices 1014 may include one or more of the user input devices. The I/O devices 1014 may be connected to the I/O interface 1008 by way of a wired connection (e.g., an Industrial Ethernet connection) or a wireless connection (e.g., a Wi-Fi connection). The I/O interface 1008 may provide an interface for communication with one or more external devices 1016. In some embodiments, the I/O interface 1008 includes one or both of an antenna and a transceiver. In some embodiments, the external devices 1016 include the well drilling system 130 or drilling sensors 150.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all of the portions of the processes and methods may be implemented by one or more of the processors/modules/applications described here.

As used throughout this application, the word "may" is used in a permissive sense (i.e., meaning having the potential to), rather than the mandatory sense (i.e., meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (e.g., by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A method of drilling a hydrocarbon well, the method comprising:

conducting a hydrocarbon well drilling operation comprising a drill bit boring a wellbore in a subsurface formation;

collecting drilling operation data, the drilling operation data comprising characteristics of the hydrocarbon well drilling operation sensed by drilling sensors over a timespan;

determining, based on the drilling operation data, drilling operation conditions, the drilling operation conditions comprising conditions of the hydrocarbon well drilling operation for instants of time within the timespan;

determining, based on application of the drilling operation conditions to a well decision tree for identifying classifications of the hydrocarbon well drilling operation, preliminary operation classifications, the preliminary operation classifications identifying a preliminary classification of the hydrocarbon well drilling operation for respective instants of time within the timespan;

determining, based on application of a majority voting operation to the preliminary operation classifications, a series of operation classifications for the hydrocarbon well drilling operation, each of the operation classifications indicating a determined classification for a respective instant of time within the timespan;

determining, based on the series of operation classifications for the hydrocarbon well drilling operation, a change of operation classifications within the series of operation classifications for the hydrocarbon well drilling operation;

conducting, in response to determining the change of operation classifications, a change point detection operation to identify a time of the change of operation classifications;

generating drilling operation characteristic data indicating the time of the change of operation classifications; and conducting the hydrocarbon well drilling operation in accordance with the time of the change of operation classifications, wherein the change point detection operation comprises, for each position of a sliding window of time across a candidate timespan containing a time associated with the change of operation classifications within the series of operation classifications:

determining a first frequency of classifications in a first sub-window within the sliding window, the first sub-window comprising a first portion of the sliding window associated with a first time segment;

determining a second frequency of classifications in a second sub-window within the sliding window, the second sub-window comprising a second portion of the sliding window associated with a second time segment adjacent the first time segment; and determining a classification divergence comprising a divergence between the first frequency of classifications in the first sub-window and the second frequency of classifications in the second sub-window, wherein the change point comprises an instant of time associated with the highest classification divergence of the classification divergences determined for the positions of the sliding window across the candidate timespan.

2. The method of claim 1, wherein the drilling operation data comprises drilling data records, and wherein each drilling data record is associated with an instant of time of the instants of time and comprises a timestamp corresponding to the instant of time and drilling characteristics corresponding to the instant of time.

3. The method of claim 2, wherein the drilling characteristics include a mud flow rate, a hook load, a hook height, a hole depth, a bit depth, a rotational speed of the drill string, and a weight on bit.

4. The method of claim 1, wherein a drilling operation condition for a given instant of time is determined based on comparison of a first set of sensed characteristics within a first time segment preceding the given instant of time to a second set of sensed characteristics within a second time segment following the given instant of time.

5. The method of claim 4, wherein the first set of sensed characteristics comprises bit depths for the first time segment, the second set of sensed characteristics comprise bit depths for the second time segment, and the drilling operation conditions comprise:

a bit plus condition that indicates whether a bit depth value for the given instant of time is greater than a minimum bit depth of the bit depths for the first time segment and is less than a maximum bit depth of the bit depths for the second time segment; and a bit minus condition that indicates whether the bit depth value for the given instant of time is less than a maximum bit depth of the bit depths for the first time segment and is greater than a minimum bit depth of the bit depths for the second time segment.

6. The method of claim 5, further comprising determining, for the hydrocarbon well drilling operation, the well decision tree, wherein a first leaf of the well decision tree considers the bit plus condition, and a second leaf of the well decision tree considers the bit minus condition.

7. The method of claim 1, wherein the majority voting operation comprises:

for each of a series of time segments within the timespan:

determining a preliminary operation classification having the highest frequency within the time segment; and associating the preliminary operation classification determined as the operation classification for the time segment, wherein the series of operation classifications for the hydrocarbon well drilling operation comprises the operation classifications for the time segment.

8. The method of claim 1, wherein the change of operation classifications within the series of operation classifications comprises a change in classifications for consecutive operation classifications of the series of operation classifications.

9. The method of claim 1, wherein the drilling operation characteristic data comprises operation records that each comprise an operation type, a start time, a stop time, a start bit depth, a start hole depth, a stop bit depth, and a stop hole depth, wherein one of the operation records comprises an operation type comprising a first classification and a stop time associated with the time of change, and a next of the operation records of the records comprises an operation type comprising a second classification and a start time associated with the time of change, and wherein the first classification is different from the second classification.

10. The method of claim 1, wherein conducting the hydrocarbon well drilling operation in accordance with the time of the change of operation classifications comprises:

identifying drilling operation parameters based on the time of the change of operation classifications; and conducting the drilling operation in accordance with the drilling operation parameters.

11. A hydrocarbon well drilling system, comprising:

a drilling system configured to conduct a hydrocarbon well drilling operation comprising a drill bit boring a wellbore in a subsurface formation, and comprising drilling sensors;

a well control system configured to perform the following operations:

collecting drilling operation data, the drilling operation data comprising characteristics of the hydrocarbon well drilling operation sensed by the drilling sensors over a timespan;

determining, based on the drilling operation data, drilling operation conditions, the drilling operation conditions comprising conditions of the hydrocarbon well drilling operation for instants of time within the timespan;

determining, based on application of the drilling operation conditions to a well decision tree for identifying classifications of the hydrocarbon well drilling operation, preliminary operation classifications, the preliminary operation classifications identifying a preliminary classification of the hydrocarbon well drilling operation for respective instants of time within the timespan;

determining, based on application of a majority voting operation to the preliminary operation classifications, a series of operation classifications for the hydrocarbon well drilling operation, each of the operation classifications indicating a determined classification for a respective instant of time within the timespan;

determining, based on the series of operation classifications for the hydrocarbon well drilling operation, a change of operation classifications within the series of operation classifications for the hydrocarbon well drilling operation;

conducting, in response to determining the change of operation classifications, a change point detection operation to identify a time of the change of operation classifications;

generating drilling operation characteristic data indicating the time of the change of operation classifications; and controlling the drilling system to conduct the hydrocarbon well drilling operation in accordance with the time of the change of operation classifications wherein the change point detection operation comprises, for each position of a sliding window of time across a candidate timespan containing a time associated with the change of operation classifications within the series of operation classifications:

determining a first frequency of classifications in a first sub-window within the sliding window, the first sub-window comprising a first portion of the sliding window associated with a first time segment;

determining a second frequency of classifications in a second sub-window within the sliding window, the second sub-window comprising a second portion of the sliding window associated with a second time segment adjacent the first time segment; and determining a classification divergence comprising a divergence between the first frequency of classifications in the first sub-window and the second frequency of classifications in the second sub-window, wherein the change point comprises an instant of time associated with the highest classification divergence of the classification divergences determined for the positions of the sliding window across the candidate timespan.

12. The system of claim 11, wherein the drilling operation data comprises drilling data records, and wherein each drilling data record is associated with an instant of time of the instants of time and comprises a timestamp corresponding to the instant of time and drilling characteristics corresponding to the instant of time.

13. The system of claim 12, wherein the drilling characteristics include a mud flow rate, a hook load, a hook height, a hole depth, a bit depth, a rotational speed of the drill string, and a weight on bit.

14. The system of claim 11, wherein a drilling operation condition for a given instant of time is determined based on comparison of a first set of sensed characteristics within a first time segment preceding the given instant of time to a second set of sensed characteristics within a second time segment following the given instant of time.

15. The system of claim 14, wherein the first set of sensed characteristics comprises bit depths for the first time segment, the second set of sensed characteristics comprise bit depths for the second time segment, and the drilling operation conditions comprise:

a bit plus condition that indicates whether a bit depth value for the given instant of time is greater than a minimum bit depth of the bit depths for the first time segment and is less than a maximum bit depth of the bit depths for the second time segment; and a bit minus condition that indicates whether the bit depth value for the given instant of time is less than a maximum bit depth of the bit depths for the first time segment and is greater than a minimum bit depth of the bit depths for the second time segment.

16. The system of claim 15, further comprising determining, for the hydrocarbon well drilling operation, the well decision tree, wherein a first leaf of the well decision tree considers the bit plus condition, and a second leaf of the well decision tree considers the bit minus condition.

17. The system of claim 11, wherein the majority voting operation comprises:

for each of a series of time segments within the timespan:

determining a preliminary operation classification having the highest frequency within the time segment; and associating the preliminary operation classification determined as the operation classification for the time segment, wherein the series of operation classifications for the hydrocarbon well drilling operation comprises the operation classifications for the time segment.

18. The system of claim 11, wherein the change of operation classifications within the series of operation classifications comprises a change in classifications for consecutive operation classifications of the series of operation classifications.

19. The system of claim 11, wherein the drilling operation characteristic data comprises operation records that each comprise an operation type, a start time, a stop time, a start bit depth, a start hole depth, a stop bit depth, and a stop hole depth, wherein one of the operation records comprises an operation type comprising a first classification and a stop time associated with the time of change, and a next of the operation records of the records comprises an operation type comprising a second classification and a start time associated with the time of change, and wherein the first classification is different from the second classification.

20. The system of claim 11, wherein controlling the drilling system to conduct the hydrocarbon well drilling operation in accordance with the time of the change of operation classifications comprises:

identifying drilling operation parameters based on the time of the change of operation classifications; and controlling the drilling system to conduct the drilling operation in accordance with the drilling operation parameters.

21. A non-transitory computer readable storage medium comprising program instructions stored thereon that are executable by a processor to perform the following operations for drilling a hydrocarbon well:

collecting drilling operation data for a hydrocarbon well drilling operation comprising a drill bit boring a wellbore in a subsurface formation, the drilling operation data comprising characteristics of the hydrocarbon well drilling operation sensed by drilling sensors over a timespan;

determining, based on the drilling operation data, drilling operation conditions, the drilling operation conditions comprising conditions of the hydrocarbon well drilling operation for instants of time within the timespan;

determining, based on application of the drilling operation conditions to a well decision tree for identifying classifications of the hydrocarbon well drilling operation, preliminary operation classifications, the preliminary operation classifications identifying a preliminary classification of the hydrocarbon well drilling operation for respective instants of time within the timespan;

determining, based on application of a majority voting operation to the preliminary operation classifications, a series of operation classifications for the hydrocarbon well drilling operation, each of the operation classifications indicating a determined classification for a respective instant of time within the timespan;

determining, based on the series of operation classifications for the hydrocarbon well drilling operation, a change of operation classifications within the series of operation classifications for the hydrocarbon well drilling operation;

conducting, in response to determining the change of operation classifications, a change point detection operation to identify a time of the change of operation classifications;

generating drilling operation characteristic data indicating the time of the change of operation classifications; and controlling a drilling system to conduct the hydrocarbon well drilling operation in accordance with the time of the change of operation classifications, wherein the change point detection operation comprises, for each position of a sliding window of time across a candidate timespan containing a time associated with the change of operation classifications within the series of operation classifications:

determining a first frequency of classifications in a first sub-window within the sliding window, the first sub-window comprising a first portion of the sliding window associated with a first time segment;

determining a second frequency of classifications in a second sub-window within the sliding window, the second sub-window comprising a second portion of the sliding window associated with a second time segment adjacent the first time segment; and determining a classification divergence comprising a divergence between the first frequency of classifications in the first sub-window and the second frequency of classifications in the second sub-window, wherein the change point comprises an instant of time associated with the highest classification divergence of the classification divergences determined for the positions of the sliding window across the candidate timespan.

* * * * *